US011383125B2

(12) United States Patent
Martinez

(10) Patent No.: US 11,383,125 B2
(45) Date of Patent: Jul. 12, 2022

(54) WEIGHTLIFTING BAR HANDLE

(71) Applicant: Gilbert Martinez, Peoria, AZ (US)

(72) Inventor: Gilbert Martinez, Peoria, AZ (US)

( * ) Notice: Subject to any disclaimer, the term of this patent is extended or adjusted under 35 U.S.C. 154(b) by 134 days.

(21) Appl. No.: 17/101,736

(22) Filed: Nov. 23, 2020

(65) Prior Publication Data

US 2022/0062693 A1 Mar. 3, 2022

Related U.S. Application Data

(60) Provisional application No. 63/073,228, filed on Sep. 1, 2020.

(51) Int. Cl.
*A63B 21/072* (2006.01)
*A63B 21/00* (2006.01)

(52) U.S. Cl.
CPC ..... *A63B 21/4035* (2015.10); *A63B 21/0724* (2013.01); *A63B 21/0726* (2013.01)

(58) Field of Classification Search
CPC ..... A63B 21/072; A63B 21/0722; A63B 21/0724; A63B 21/0726; A63B 21/0728; A63B 21/075; A63B 21/4035
See application file for complete search history.

(56) References Cited

U.S. PATENT DOCUMENTS

| | | | | | |
|---|---|---|---|---|---|
| 4,231,569 | A * | 11/1980 | Rae | A63B 23/1281 | 482/93 |
| 4,743,017 | A * | 5/1988 | Jaeger | A63B 21/0728 | 482/108 |
| 5,573,484 | A * | 11/1996 | Carpenter | A63B 21/00181 | 482/108 |
| 8,267,841 | B1 * | 9/2012 | Allison | A63B 21/075 | 482/106 |
| 9,731,159 | B2 * | 8/2017 | Reynolds | A63B 21/4035 | |
| 10,086,225 | B2 * | 10/2018 | Sheppard | A63B 21/0728 | |
| 11,130,013 | B2 * | 9/2021 | Tabone | A63B 21/0724 | |
| 2011/0111929 | A1 * | 5/2011 | Allison | A63B 21/072 | 482/93 |
| 2015/0105224 | A1 * | 4/2015 | Odneal | A63B 21/0726 | 164/47 |
| 2018/0140890 | A1 * | 5/2018 | Sheppard | A63B 21/0728 | |

* cited by examiner

*Primary Examiner* — Joshua Lee
(74) *Attorney, Agent, or Firm* — Bruce A. Lev

(57) ABSTRACT

An improved weightlifting handle having two spaced grip members connected to two spaced weightlifting bar connector portions adapted to respectively removably attach to barbells and dumbbells of differing diameters.

18 Claims, 4 Drawing Sheets

WEIGHTLIFTING BAR HANDLE

CROSS-REFERENCE TO RELATED APPLICATION

The present application is related to and claims priority from prior provisional application Ser. No. 63/073,228 filed on Sep. 1, 2020, which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The present invention relates generally to the field of handles removably attachable to weightlifting barbells and dumbbells.

2. Description of the Related Art

Previous weightlifting barbell handles are usually removably attached to weightlifting bars via a sleeve portion sliding over an end portion of a respective weightlifting bar before placing weights/plates thereon. This is inconvenient since a user would need to remove the weights/plates whenever they want to remove or replace the handle. Furthermore, these sleeve portions are formed to receive and attach to bars of only one specific diameter.

Previous weightlifting dumbbell handles are removably attached to dumbbell bars via a detachable connector spaced from its respective hand grip. These detachable connectors are formed to receive bars of only one specific diameter. Furthermore, previous dumbbell handles are formed having only one hand grip member thereby limiting a user to lift the dumbbell with only one hand.

Therefore, a need exists to provide a weightlifting bar handle that can be more easily releasably attached to barbell or dumbbell bars having various diameters. Furthermore, the weightlifting handle must also have two spaced hand grip members to thereby offer a user a means to lift and exercise barbells and dumbbells with two hands.

BRIEF SUMMARY OF THE INVENTION

In view of the foregoing disadvantages inherent in previous weightlifting handles, the present invention provides an improved weightlifting handle having two spaced grip members connected to two spaced weightlifting bar connector portions adapted to respectively removably attach to barbells and dumbbells of differing diameters. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an improved weightlifting handle, constructed and operative according to the teachings of the present invention.

Figure 1:
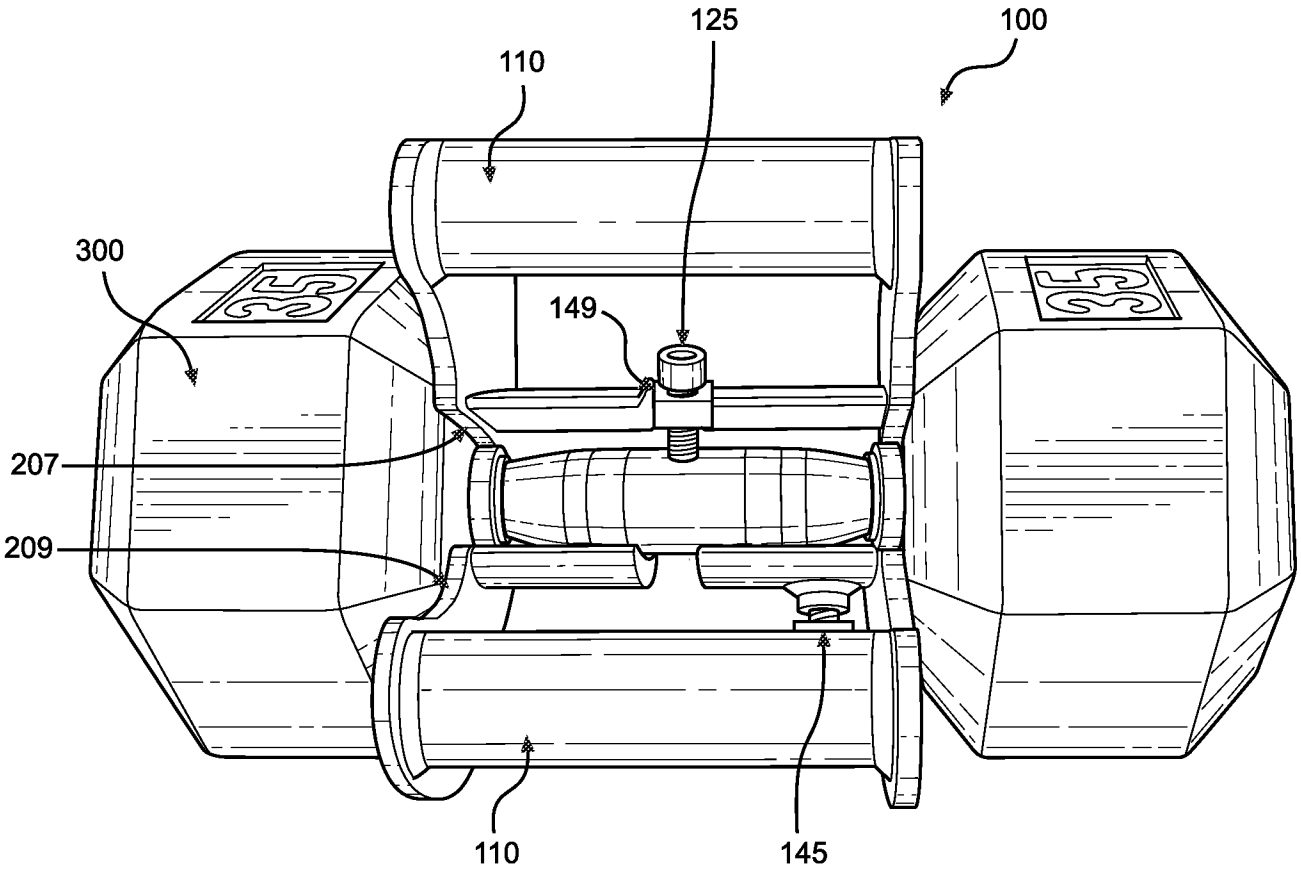
FIG. 1 shows a top view illustrating the improved weightlifting handle attached to a dumbbell according to the preferred embodiment of the present invention.

The various embodiments of the present invention will hereinafter be described in conjunction with the appended drawings.

DETAILED DESCRIPTION

As discussed above, embodiments of the present invention relate to an improved weightlifting handle having two spaced grip members connected to two spaced weightlifting bar connector portions adapted to respectively removably attach to barbells and dumbbells of differing diameters.

Referring now to FIGS. 1-4, the improved weightlifting handle 100 has two spaced grip members 110 connected to a first weightlifting bar connector portion 120 and a second weightlifting bar connector portion 140. The first weightlifting bar connector portion 120 is adapted to respectively removably attach to barbells and dumbbells having a diameter of between 1 inch and 1.5 inches. The second weightlifting bar connector portion 140 is adapted to respectively removably attach to barbells and/or barbell sleeves as used in Olympic weightlifting bars, and dumbbells having a diameter of between 2 inches and 2.5 inches. When using the first weightlifting bar connector portion 120 set screw 125 is used to securely and releasably retain the bar therein. When using the second weightlifting bar connector portion 140 set screw 145 is used to securely and releasably retain the bar therein. The first weightlifting bar connector portion 120 further incorporates curved edge 221 of a first side plate 200 and curved edge 222 of a second side plate 201. The second weightlifting bar connector portion 140 further incorporates curved plate members 141 and 142 and 144. Set screw 145 is used in conjunction with set screw aperture 146 in curved plate 142, and set screw 125 is used in conjunction with set screw aperture 148 in curved plate 144.

Figure 2:
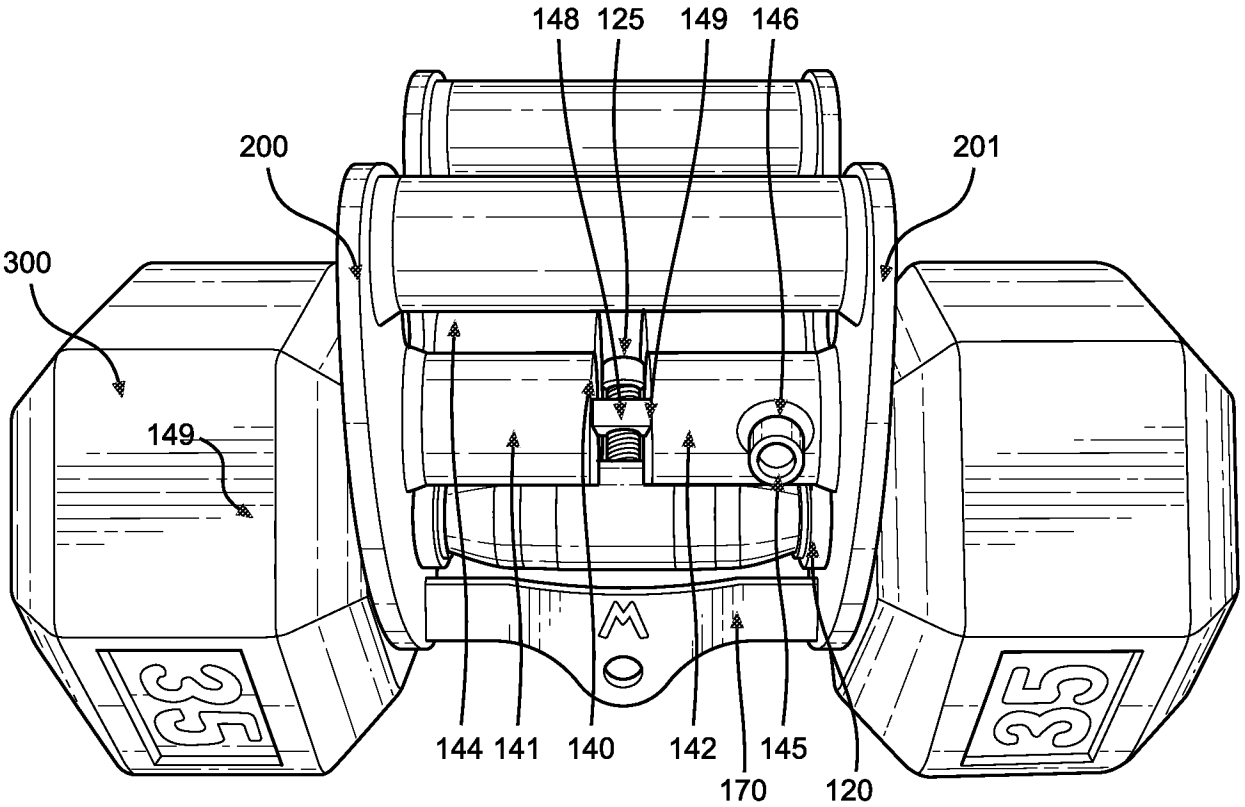
FIG. 2 shows a side view illustrating the improved weightlifting handle attached to a dumbbell according to the preferred embodiment of the present invention.
Figure 3:
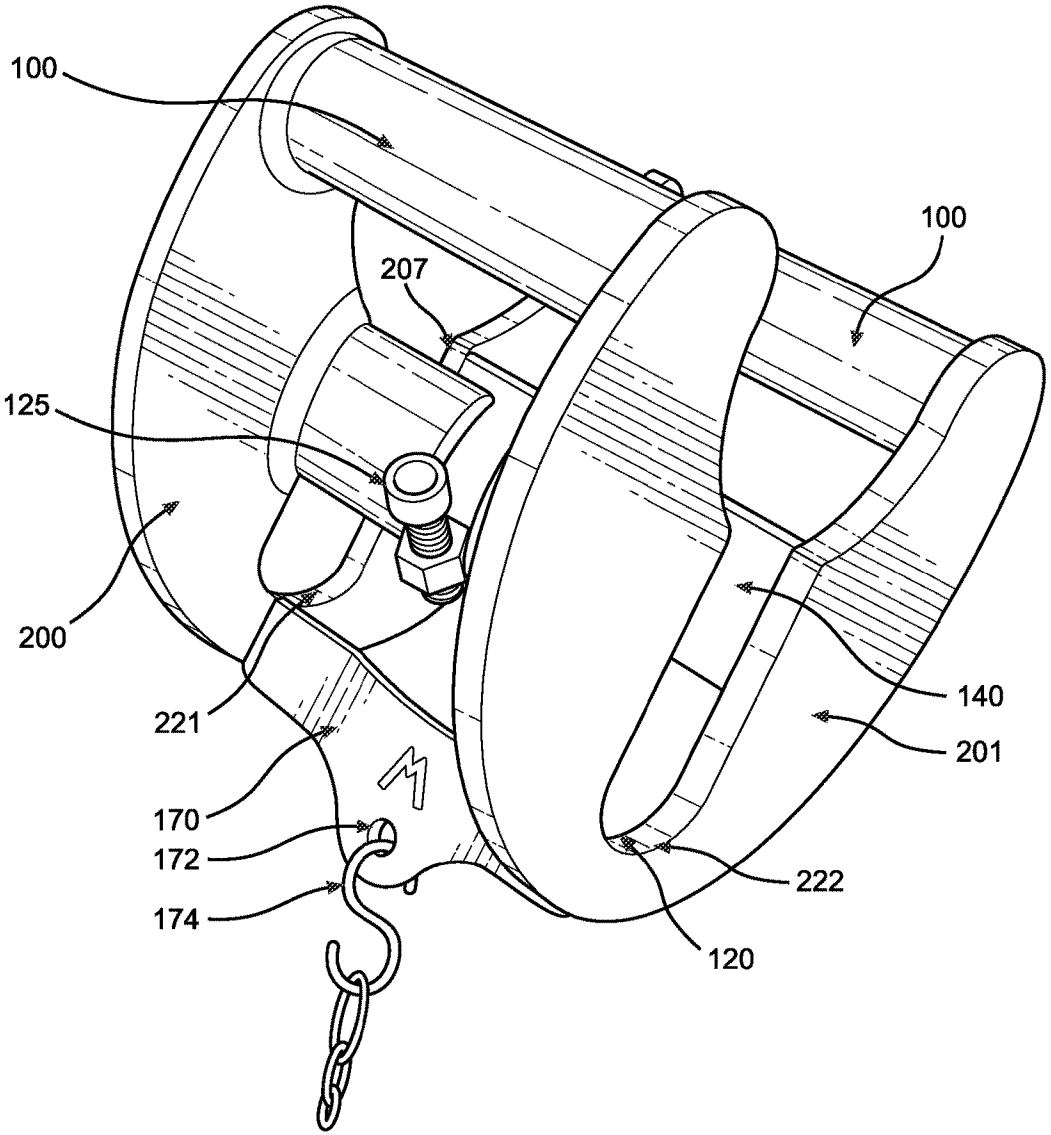
FIG. 3 shows a perspective view illustrating the improved weightlifting handle according to the preferred embodiment of the present invention.

Referring now to FIGS. 1 and 2, a 1-inch diameter dumbbell 300 is placed within first weightlifting bar connector portion 120, and set screw 125 is tightened.

Figure 4:
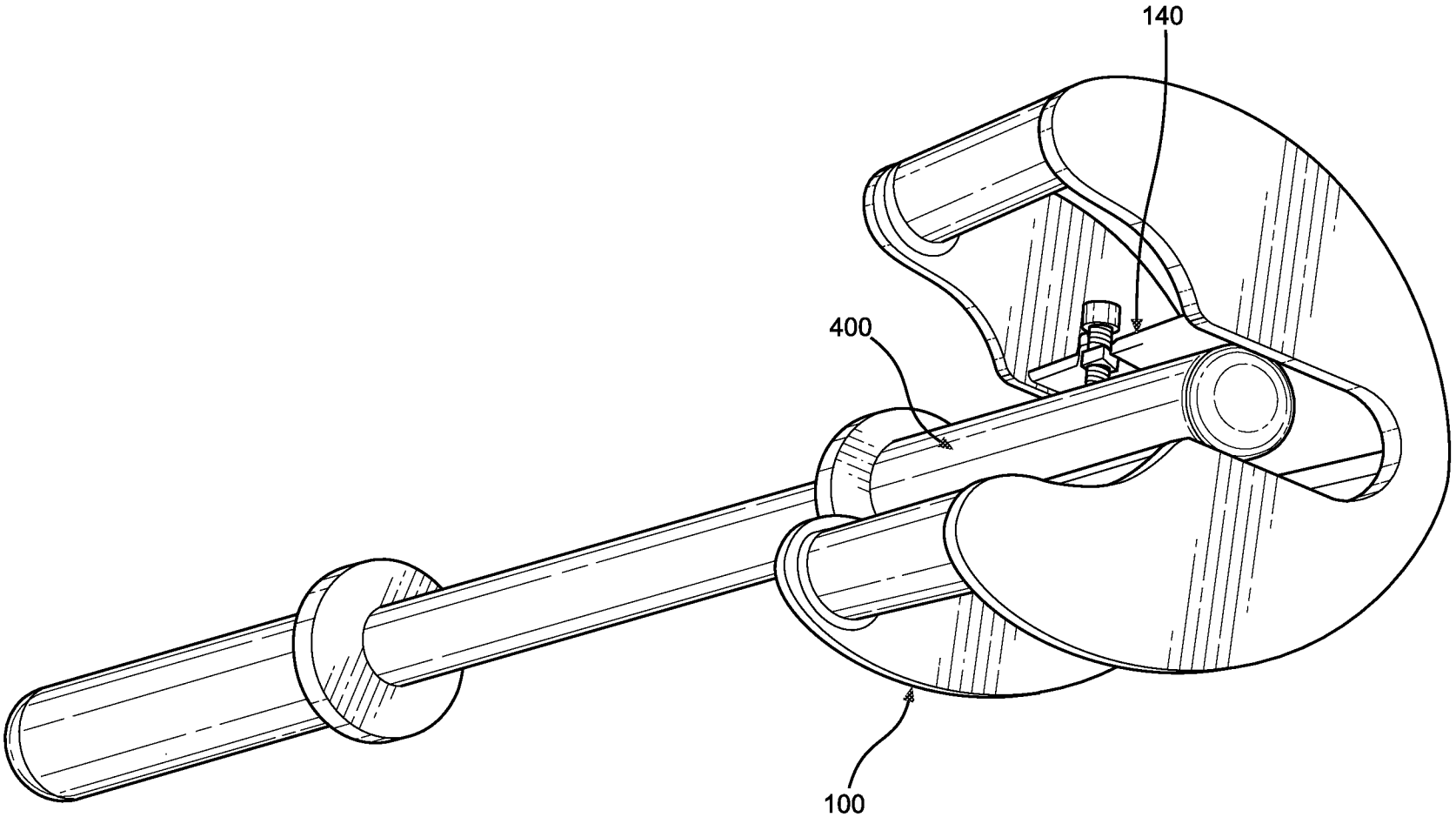
FIG. 4 shows a perspective view illustrating the improved weightlifting handle attached to a sleeve of an Olympic weightlifting bar according to the preferred embodiment of the present invention.

Referring now to FIG. 4, a 2-inch diameter barbell 400, usually an end sleeve of a standard Olympic weightlifting bar, is placed within second weightlifting bar connector portion 140, and set screw 145 is tightened.

Once the improved weightlifting bar handle 100 is securely attached to either a dumbbell 300 or a barbell 400, a weightlifter can choose between holding the improved weightlifting bar handle with either one hand or both hands to perform various exercises.

In the preferred embodiment, the improved weightlifting bar handle comprises a first side plate 200 including a first curved edge 221 sized and shaped to accommodate a weightlifting bar of a first diameter, and two spaced second curved edges 207 and 209 defining a circular shape that is sized and shaped to accommodate the circular shape of a weightlifting bar and/or sleeve of a second diameter. The first curved edge 221 is spaced from the two spaced second curved edges 207 and 209, and wherein the second diameter is larger than the first diameter. The improved weightlifting bar handle further comprises a second side plate 201 that is spaced from said first side plate 200 and includes a first curved edge 222 also sized and shaped to accommodate a weightlifting bar of said first diameter, wherein the first curved edge of said first side plate and said first curved edge of said second side plate form the first weightlifting bar connector portion 120. The improved weightlifting bar handle further comprises a first curved plate 144 including a first set screw aperture 148, wherein the first curved plate 144 is connected to a first (207) of the two spaced second curved edges and is connected between the first and second side plates 200 and 201; and a second curved plate, that may be formed as two spaced curved plate portions 141 and 142, that includes a second set screw aperture 146, wherein one of the second curved plate portions (141) is connected to the second (209) of said two spaced second curved edges, wherein said second curved plate (141 and 142) is connected between the first and second side plates (200 and 201) and is spaced from the first curved plate, and wherein the first curved plate and the second curved plate form a second weightlifting bar connector portion 140. The second weightlifting bar connector portion has a diameter that is larger than the first weightlifting bar connector portion. The improved weightlifting bar handle further comprises a first grip 110 connected between the first and second plates (200 and 201) and is spaced from the first and second weightlifting bar connector portions; a second grip 110 connected between the first and second plates and is spaced from the first grip, wherein the second grip is spaced from the first and second weightlifting bar connector portions, and wherein said first and second grips are sized, shaped, positioned, and adapted such that a user can grip one or both of the first and second grips at the same time and manipulate an attached weightlifting bar. The improved weightlifting bar handle further comprises a first set screw 125 removably and adjustably placed within the first set screw aperture 148 of the first curved plate 144, and is adapted to adjustably extend into the first weightlifting bar connector portion 120, to thereby releasably hold a weightlifting bar therein; and a second set screw 145 removably and adjustably placed within said second set screw aperture 146 of said second curved plate, and is adapted to adjustably extend into said second weightlifting bar connector portion, to thereby releasably hold a weightlifting bar within said second weightlifting bar connector portion.

As shown in FIGS. 1 and 4, the improved weightlifting bar handle 100 can be releasably attached to weightlifting bars of varying diameters. The improved weightlifting bar handle 100 can be gripped by either one hand of a user or both hands of a user.

The first curved plate 144 may further include a set screw extension 149 extending outwardly from the first weightlifting bar connector portion and incorporates the first set screw aperture 148 therethrough. As mentioned previously, the second curved plate may formed from a first curved plate portion 141 connected to and extending from the first plate 200, and a second curved plate portion 142 connected to and extending from the second plate 201, wherein the second curved plate portion 142 incorporates the second set screw aperture 146 therethrough.

The improved weightlifting bar handle may further comprise a connector plate 170 connected between said first and second side plates (200 and 201) and provides increased stability to the improved weightlifting handle. The connector plate 170 includes an aperture 172 therethrough adopted to allow weightlifting attachments, ie., 174, to be releasably connected thereto.

The improved weightlifting bar handle 100 may formed from cast iron, steel, aluminum, brass, ceramic, or carbon fiber.

One important advantage of the instant configuration over the prior art is that the improved weightlifting bar handle can be quickly and easily attached and detached from respective dumbbells or barbells without removing any weight plates, especially when some weight plates are permanent features upon the weight bar, as in many dumbbells.

Another important advantage of the instant configuration over the prior art is that the instant handle can be quickly and easily attached and detached from dumbbells and barbells of varying diameters.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claim:

1. An improved weightlifting bar handle comprising:

a first side plate including:

a first curved edge;

wherein said first curved edge is sized and shaped to accommodate a weightlifting bar of a first diameter; and two spaced second curved edges;

wherein said two spaced second curved edges define a circular shape that is sized and shaped to accommodate a weightlifting bar of a second diameter;

wherein said first curved edge is spaced from said two spaced second curved edges; and wherein said second diameter is larger than said first diameter;

a second side plate including:

a first curved edge;

wherein said first curved edge is sized and shaped to accommodate a weightlifting bar of said first diameter;

wherein said second side plate is spaced from said first side plate;

wherein said first curved edge of said first side plate and said first curved edge of said second side plate form a first weightlifting bar connector portion;

a first curved plate including:

a first set screw aperture;

wherein said first curved plate is connected to a first of said two spaced second curved edges; and wherein said first curved plate is connected between said first and second side plates;

a second curved plate including:

a second set screw aperture;

wherein said second curved plate is connected to a second of said two spaced second curved edges; and wherein said second curved plate is connected between said first and second side plates and is spaced from said first curved plate;

wherein said first curved plate and said second curved plate form a second weightlifting bar connector portion;

wherein said second weightlifting bar connector portion has a diameter that is larger than said first weightlifting bar connector portion;

a first grip;

wherein said first grip is connected between said first and second plates; and wherein said first grip is spaced from said first and second weightlifting bar connector portions;

a second grip;

wherein said second grip is connected between said first and second plates and is spaced from said first grip; and wherein said second grip is spaced from said first and second weightlifting bar connector portions;

wherein said first and second grips are sized, shaped, positioned, and adapted such that a user can grip one or both of said first and second grips at the same time and manipulate an attached weightlifting bar;

a first set screw;

wherein said first set screw is removably and adjustably placed within said first set screw aperture of said first curved plate, and is adapted to adjustably extend into said first weightlifting bar connector portion, to thereby releasably hold a weightlifting bar within said first weightlifting bar connector portion; and a second set screw;

wherein said second set screw is removably and adjustably placed within said second set screw aperture of said second curved plate, and is adapted to adjustably extend into said second weightlifting bar connector portion, to thereby releasably hold a weightlifting bar within said second weightlifting bar connector portion;

wherein said improved weightlifting bar handle can be releasably attached to weightlifting bars of varying diameters; and wherein said improved weightlifting bar handle can be gripped by either one hand of a user or both hands of a user.

2. The improved weightlifting bar handle of claim 1, wherein said first curved plate further includes:

a set screw extension;

wherein said set screw extension extends outwardly from said first weightlifting bar connector portion and incorporates said first set screw aperture therethrough.

3. The improved weightlifting bar handle of claim 1, wherein said second curved plate is formed from a first curved plate portion connected to and extending from said first plate, and a second curved plate portion connected to and extending from said second plate; and wherein said second curved plate portion incorporates said second set screw aperture therethrough.

4. The improved weightlifting bar handle of claim 1, further comprising:

a connector plate;

wherein said connector plate is connected between said first and second side plates and provides increased stability to the improved weightlifting handle.

5. The improved weightlifting bar handle of claim 4, wherein said connector plate includes an aperture therethrough adapted to allow weightlifting attachments to be releasably connected thereto.

6. The improved weightlifting bar handle of claim 1, wherein said improved weightlifting bar handle is formed from a material chosen from a list of materials consisting of cast iron, steel, aluminum, brass, ceramic, and carbon fiber.

7. A combination of a weightlifting dumbbell and an improved weightlifting bar handle, said combination comprising:

a weightlifting dumbbell including:

two spaced weighted portions; and a handle connected between said two spaced weighted portions; and an improved weightlifting bar handle comprising:

a first side plate including:

a first curved edge;

wherein said first curved edge is sized and shaped to accommodate a weightlifting bar of a first diameter; and two spaced second curved edges;

wherein said two spaced second curved edges define a circular shape that is sized and shaped to accommodate a weightlifting bar of a second diameter;

wherein said first curved edge is spaced from said two spaced second curved edges; and wherein said second diameter is larger than said first diameter;

a second side plate including:

a first curved edge;

wherein said first curved edge is sized and shaped to accommodate a weightlifting bar of said first diameter;

wherein said second side plate is spaced from said first side plate;

wherein said first curved edge of said first side plate and said first curved edge of said second side plate form a first weightlifting bar connector portion;

a first curved plate including:

a first set screw aperture;

wherein said first curved plate is connected to a first of said two spaced second curved edges; and wherein said first curved plate is connected between said first and second side plates;

a second curved plate including:

a second set screw aperture;

wherein said second curved plate is connected to a second of said two spaced second curved edges; and wherein said second curved plate is connected between said first and second side plates and is spaced from said first curved plate;

wherein said first curved plate and said second curved plate form a second weightlifting bar connector portion;

wherein said second weightlifting bar connector portion has a diameter that is larger than said first weightlifting bar connector portion;

a first grip;

wherein said first grip is connected between said first and second plates; and wherein said first grip is spaced from said first and second weightlifting bar connector portions;

a second grip;

wherein said second grip is connected between said first and second plates and is spaced from said first grip; and wherein said second grip is spaced from said first and second weightlifting bar connector portions;

wherein said first and second grips are sized, shaped, positioned, and adapted such that a user can grip one or both of said first and second grips at the same time and manipulate an attached weightlifting bar;

a first set screw;

wherein said first set screw is removably and adjustably placed within said first set screw aperture of said first curved plate, and is adapted to adjustably extend into said first weightlifting bar connector portion, to thereby releasably hold a weightlifting bar within said first weightlifting bar connector portion; and a second set screw;

wherein said second set screw is removably and adjustably placed within said second set screw aperture of said second curved plate, and is adapted to adjustably extend into said second weightlifting bar connector portion, to thereby releasably hold a weightlifting bar within said second weightlifting bar connector portion;

wherein said improved weightlifting bar handle can be releasably attached to weightlifting bars of varying diameters; and wherein said improved weightlifting bar handle can be gripped by either one hand of a user or both hands of a user;

wherein said handle of said weightlifting dumbbell has a diameter equal to or smaller than said first diameter formed by said first curved edges of said first and second side plates.

8. The combination of claim 7, wherein said first curved plate further includes:

a set screw extension;

wherein said set screw extension extends outwardly from said first weightlifting bar connector portion and incorporates said first set screw aperture therethrough.

9. The combination of claim 7, wherein said second curved plate is formed from a first curved plate portion connected to and extending from said first plate, and a second curved plate portion connected to and extending from said second plate; and wherein said second curved plate portion incorporates said second set screw aperture therethrough.

10. The combination of claim 7, further comprising:

a connector plate;

wherein said connector plate is connected between said first and second side plates and provides increased stability to the improved weightlifting handle.

11. The combination of claim 10, wherein said connector plate includes an aperture therethrough adapted to allow weightlifting attachments to be releasably connected thereto.

12. The combination of claim 7, wherein said improved weightlifting bar handle is formed from a material chosen from a list of materials consisting of cast iron, steel, aluminum, brass, ceramic, and carbon fiber.

13. A combination of a weightlifting barbell and an improved weightlifting bar handle, said combination comprising:

a weightlifting barbell including:

two spaced sleeves; and a handle connected between said two spaced sleeves; and an improved weightlifting bar handle comprising:

a first side plate including:

a first curved edge;

wherein said first curved edge is sized and shaped to accommodate a weightlifting bar of a first diameter; and two spaced second curved edges;

wherein said two spaced second curved edges define a circular shape that is sized and shaped to accommodate a weightlifting bar of a second diameter;

wherein said first curved edge is spaced from said two spaced second curved edges; and wherein said second diameter is larger than said first diameter;

a second side plate including:

a first curved edge;

wherein said first curved edge is sized and shaped to accommodate a weightlifting bar of said first diameter;

wherein said second side plate is spaced from said first side plate;

wherein said first curved edge of said first side plate and said first curved edge of said second side plate form a first weightlifting bar connector portion;

a first curved plate including:

a first set screw aperture;

wherein said first curved plate is connected to a first of said two spaced second curved edges; and wherein said first curved plate is connected between said first and second side plates;

a second curved plate including:

a second set screw aperture;

wherein said second curved plate is connected to a second of said two spaced second curved edges; and wherein said second curved plate is connected between said first and second side plates and is spaced from said first curved plate;

wherein said first curved plate and said second curved plate form a second weightlifting bar connector portion;

wherein said second weightlifting bar connector portion has a diameter that is larger than said first weightlifting bar connector portion;

a first grip;

wherein said first grip is connected between said first and second plates; and wherein said first grip is spaced from said first and second weightlifting bar connector portions;

a second grip;

wherein said second grip is connected between said first and second plates and is spaced from said first grip; and wherein said second grip is spaced from said first and second weightlifting bar connector portions;

wherein said first and second grips are sized, shaped, positioned, and adapted such that a user can grip one or both of said first and second grips at the same time and manipulate an attached weightlifting bar;

a first set screw;

wherein said first set screw is removably and adjustably placed within said first set screw aperture of said first curved plate, and is adapted to adjustably extend into said first weightlifting bar connector portion, to thereby releasably hold a weightlifting bar within said first weightlifting bar connector portion; and a second set screw;

wherein said second set screw is removably and adjustably placed within said second set screw aperture of said second curved plate, and is adapted to adjustably extend into said second weightlifting bar connector portion, to thereby releasably hold a weightlifting bar within said second weightlifting bar connector portion;

wherein said improved weightlifting bar handle can be releasably attached to weightlifting bars of varying diameters; and wherein said improved weightlifting bar handle can be gripped by either one hand of a user or both hands of a user;

wherein said two spaced sleeves of said weightlifting barbell both have a diameter equal to said diameter of said circular shape formed by said two spaced second curved edges of said first side plate.

14. The combination of claim 13, wherein said first curved plate further includes:

a set screw extension;

wherein said set screw extension extends outwardly from said first weightlifting bar connector portion and incorporates said first set screw aperture therethrough.

15. The combination of claim 13, wherein said second curved plate is formed from a first curved plate portion connected to and extending from said first plate, and a second curved plate portion connected to and extending from said second plate; and wherein said second curved plate portion incorporates said second set screw aperture therethrough.

16. The combination of claim 13, further comprising:

a connector plate;

wherein said connector plate is connected between said first and second side plates and provides increased stability to the improved weightlifting handle.

17. The combination of claim 16, wherein said connector plate includes an aperture therethrough adapted to allow weightlifting attachments to be releasably connected thereto.

18. The combination of claim 13, wherein said improved weightlifting bar handle is formed from a material chosen from a list of materials consisting of cast iron, steel, aluminum, brass, ceramic, and carbon fiber.

* * * * *